US009872564B2

(12) United States Patent
Tsuyuki et al.

(10) Patent No.: US 9,872,564 B2
(45) Date of Patent: Jan. 23, 2018

(54) OVERTURN PREVENTING DEVICE

(71) Applicant: KYB CORPORATION, Minato-ku, Tokyo (JP)

(72) Inventors: Yasuo Tsuyuki, Tokyo (JP); Masakazu Nakazato, Tokyo (JP); Shinichi Sekine, Tokyo (JP); Masanori Ogura, Tokyo (JP); Teruhiko Inoue, Tokyo (JP); Kenji Isshin, Tokyo (JP); Keita Abe, Tokyo (JP)

(73) Assignee: KYB CORPORATION, Tokyo (JP)

( * ) Notice: Subject to any disclaimer, the term of this patent is extended or adjusted under 35 U.S.C. 154(b) by 0 days.

(21) Appl. No.: 15/504,540

(22) PCT Filed: Aug. 6, 2015

(86) PCT No.: PCT/JP2015/072336

§ 371 (c)(1),
(2) Date: Feb. 16, 2017

(87) PCT Pub. No.: WO2016/031516

PCT Pub. Date: Mar. 3, 2016

(65) Prior Publication Data

US 2017/0231390 A1 Aug. 17, 2017

(30) Foreign Application Priority Data

Aug. 28, 2014 (JP) ..... 2014-173765

(51) Int. Cl.
*F16M 13/00* (2006.01)
*A47B 97/00* (2006.01)

(52) U.S. Cl.
CPC ..... *A47B 97/00* (2013.01); *A47B 2097/008* (2013.01)

(58) Field of Classification Search
USPC ..... 248/636
See application file for complete search history.

(56) References Cited

U.S. PATENT DOCUMENTS 1,460,771 A * 7/1923 Stoner ..... B60G 11/14 105/106
4,480,731 A * 11/1984 Izeki ..... E04B 1/98 188/130

(Continued)

FOREIGN PATENT DOCUMENTS

JP 3016271 U 9/1995
JP 3028334 U 9/1996
JP 2011-161085 A 8/2011

OTHER PUBLICATIONS

International Search Report for PCT/JP2015/072336, dated Oct. 6, 2015 in English & Japanese Language.

*Primary Examiner* — Monica E Millner
(74) *Attorney, Agent, or Firm* — Smith, Gambrell & Russell, LLP

(57) ABSTRACT

Providing an overturn preventing device which can successfully prevent overturn of an article. The overturn preventing device includes a damper mounted between a piece of furniture and a ceiling and a setting member connected to both ends of the damper. The setting member has a first setting part body and a second setting part body. The first and second setting part bodies and of the setting member are spread when the overturn preventing device is mounted between the furniture and the ceiling. The setting member assumes such a shape as to extend in one direction when the first and second setting part bodies and are unspread.

9 Claims, 7 Drawing Sheets

(56) References Cited

U.S. PATENT DOCUMENTS

| | | | | |
|---|---|---|---|---|
| 6,708,940 | B2 * | 3/2004 | Ligertwood | F16M 11/10 248/279.1 |
| 6,840,016 | B1 * | 1/2005 | Mualla | E04H 9/02 52/167.1 |
| 2004/0128921 | A1 * | 7/2004 | Mualla | E01D 11/04 52/167.1 |
| 2009/0283944 | A1 * | 11/2009 | Schordine | B60N 2/502 267/140.11 |

* cited by examiner

OVERTURN PREVENTING DEVICE

TECHNICAL FIELD

The present invention relates to an overturn preventing device.

BACKGROUND ART

Patent Document 1 discloses a conventional overturn preventing device. This overturn preventing device is mounted between a top surface of a piece of furniture installed on a floor and a ceiling. The overturn preventing device includes a support pillar with a built-in spring and setting members attached to both ends of the support pillar respectively. Each setting member includes a disk-shaped setting part body and a columnar shaft vertically extending from a center of one side surface of the setting part body. The shafts of the setting members are inserted into both ends of the support pillar respectively, and at least one of the shafts is disposed to be axially movable forward and backward. The spring applies an elastic force to each setting member which is movable forward and backward in a lengthwise direction of the overturn preventing device. While the spring is slightly compressed, the setting part body of one setting member is caused to abut against the top surface of the furniture and the setting part body of the other setting member is caused to abut against the ceiling. Thus, the overturn preventing device is mounted between the top surface of the furniture and the ceiling with an axis line extending in a vertical direction, thereby preventing the furniture from being overturned due to quakes of earthquake or the like.

PRIOR ART DOCUMENT

Patent Documents

Patent Document 1: Japanese Utility Model Registration No. 3028334

SUMMARY OF THE INVENTION

Problem to be Overcome by the Invention

However, when the furniture on which the overturn preventing device of Patent Document 1 is mounted is tilted by quakes of earthquake or the like, a force of the overturn preventing device preventing overturn of the furniture concentrates on a part of the top surface of the furniture or the ceiling which part the setting part body of the setting member abuts against. Accordingly, when the overturn preventing device is mounted while the setting part body abuts against a part having low strength of the top surface of the furniture or the ceiling, there is a possibility that the top surface of the furniture or the ceiling would be broken when the furniture is tilted by quakes of earthquake or the like. In this case, the overturn preventing device cannot successfully apply a force to the furniture, with the result that the furniture cannot be prevented from being overturned.

The present invention was made in view of the above-described circumstances in the conventional art and provides an overturn preventing device which can successfully prevent articles from being overturned.

Means for Overcoming the Problem

An overturn preventing device according to the present invention includes a damper mounted between an article and a ceiling or the like, and a setting member connected to at least one of two ends of the damper and having a plurality of setting part bodies which is spread when the overturn preventing device is mounted between the article and the ceiling or the like. The setting member assumes such a shape as to extend in one direction when the setting part bodies are unspread.

In the overturn preventing device according to the present invention, the setting member may have a connecting part rotatably connected to the one end of the damper. In the overturn preventing device according to the present invention, furthermore, the setting part bodies may have fitting portions which are fitted with each other when spread, so that abutting surfaces are coplanar.

BEST MODE FOR CARRYING OUT THE INVENTION

First to third embodiments of the overturn preventing devices of the present invention will be described with reference to the drawings.

First Embodiment

Figure 1:
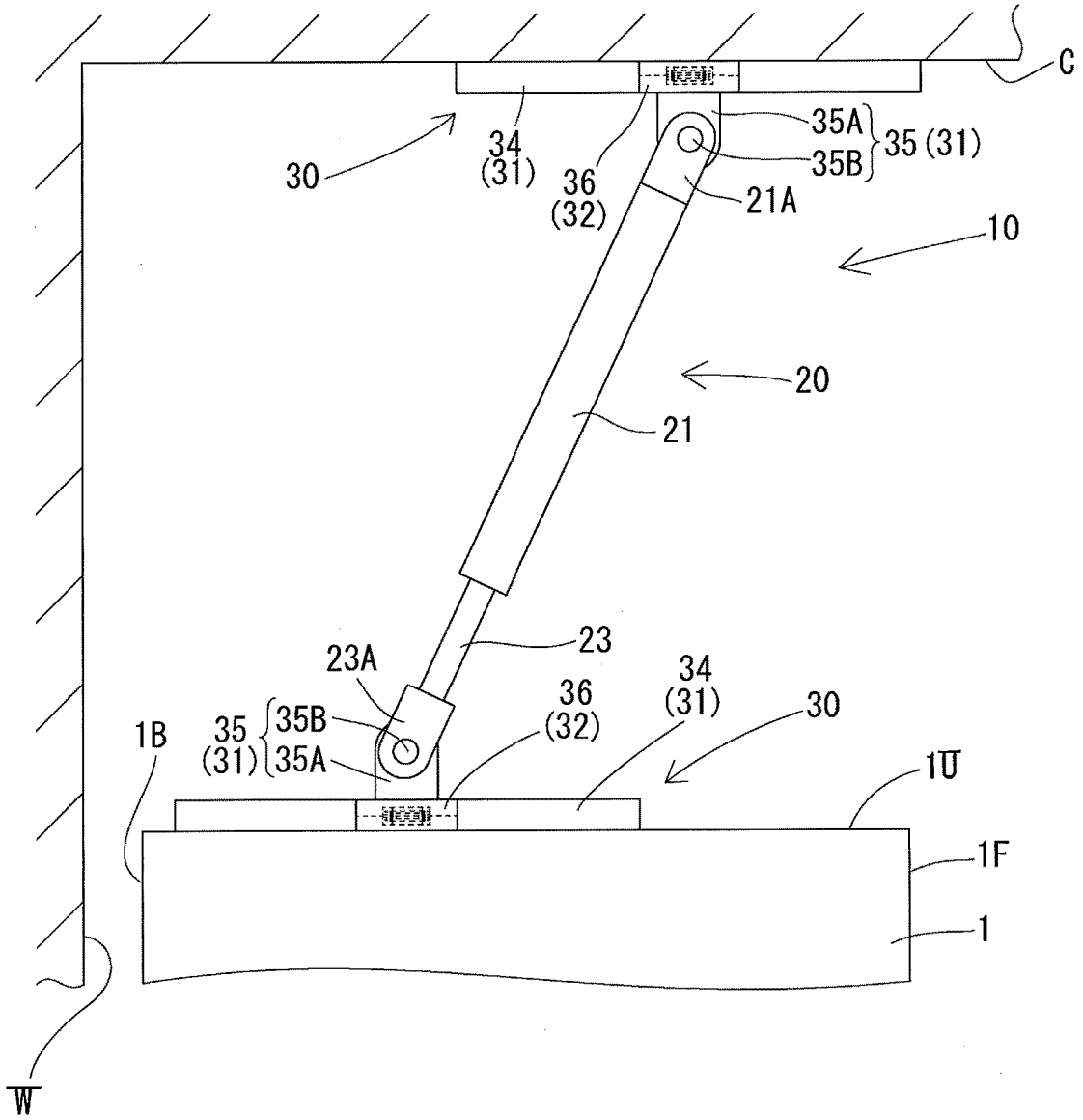
FIG. 1 is a side elevation of the overturn preventing device of a first embodiment, mounted between a top surface of furniture and the ceiling.

At least one overturn preventing device 10 of the first embodiment is mounted between a top surface 1U of a piece of furniture 1 installed on a floor surface (not shown) and a ceiling C while a rear surface 1B of the furniture 1 is opposed to a wall surface W extending in a vertical direction from the floor surface, as shown in FIG. 1. The furniture 1 is formed into a cuboid shape and has a door, drawers (neither shown) and the like in a front 1F, so that clothes, accessories and the like can be housed in the furniture 1. The furniture 1 has a rectangle-shaped horizontal section long in a right-left direction (a depthwise direction in FIG. 1). When the overturn preventing device 10 is not mounted on the furniture 1, the furniture 1 would possibly be tilted forward (rightward in FIG. 1) by quakes of earthquake or the like thereby to be overturned.

The overturn preventing device 10 includes a damper 20 mounted between the top surface 1U of the furniture 1 and the ceiling C and two setting members 30 connected to both ends of the damper 20 and mounted on the top surface 1U of the furniture 1 and the ceiling C, respectively.

The damper 20 has a cylinder 21, a piston (not shown), a rod 23 and a rod guide (not shown). The cylinder 21 has a bottomed cylindrical shape. The rod guide closes an opening of the cylinder 21. The piston is slidably inserted into the cylinder 21. The rod 23 has a proximal end connected to the piston and extends through the rod guide. The rod 23 has a distal end side protruding out of the cylinder 21. The cylinder 21 is filled with operating oil and a gas.

The damper 20 is a compression damper in which a damping force generated during an extending operation is smaller than a damping force generated during a compressing operation. The extending operation of the damper 20 refers to an operation which increases an amount of protrusion of the rod 23 out of the cylinder 21 and an entire length of the damper 20. On the other hand, the compressing operation of the damper 20 refers to an operation which reduces an amount of protrusion of the rod 23 out of the cylinder 21 and the entire length of the damper 20.

A mechanism that the damper 20 generates a damping force will be described. Since the mechanism has a known structure, diagrammatic representation is eliminated. The cylinder 21 has an interior divided by the piston into a rod side pressure chamber in which the proximal end of the rod 23 is housed and a counter-rod side pressure chamber. The piston is formed with an orifice which is a throttle valve communicating between both pressure chambers. The orifice functions as a damping force generator which applies resistance to a flow of the operating oil between the rod side pressure chamber and the counter-rod side pressure chamber with the extending/compressing operation of the damper 20. Furthermore, the piston is formed with a communication path communicating via a check valve with both pressure chambers. The check valve allows the operating oil to flow from the rod side pressure chamber to the counter-rod side pressure chamber and blocks reverse flow of the operating oil. Accordingly, the damper 20 has two flow paths of the operating oil from the rod side pressure chamber to the counter-rod side pressure chamber during the extending operation, that is, one flow path including the orifice and the other flow path including the communication path. On the other hand, the damper 20 has only one flow path of the operating oil from the counter-rod side pressure chamber to the rod side pressure chamber through the orifice during the compressing operation. Accordingly, the damping force generated by the damper 20 during the extending operation is smaller than the damping force generated by the damper 20 during the compressing operation.

Each setting member 30 has a first setting part body 31, a second setting part body 32 and a rotating shaft 33 to which the first and second setting part bodies 31 and 32 are rotatably connected, as shown in FIGS. 2 to 5. The first setting part body 31 includes a first flat plate 34 having a rectangle shape and extending in one direction, and a connecting part 35 which is provided on a central part of an obverse side of the first flat plate 34 and to which one of ends of the damper 20 is connected. The obverse side of the first flat plate 34 refers to a surface thereof located away from the top surface 1U of the furniture 1 or the ceiling C to which the setting member 30 is mounted when the overturn preventing device 10 is mounted between the top surface 1U of the furniture 1 and the ceiling C. The reverse side of the first flat plate 34 refers to a surface thereof opposed to the obverse side (the same shall apply hereinafter).

Figure 3:
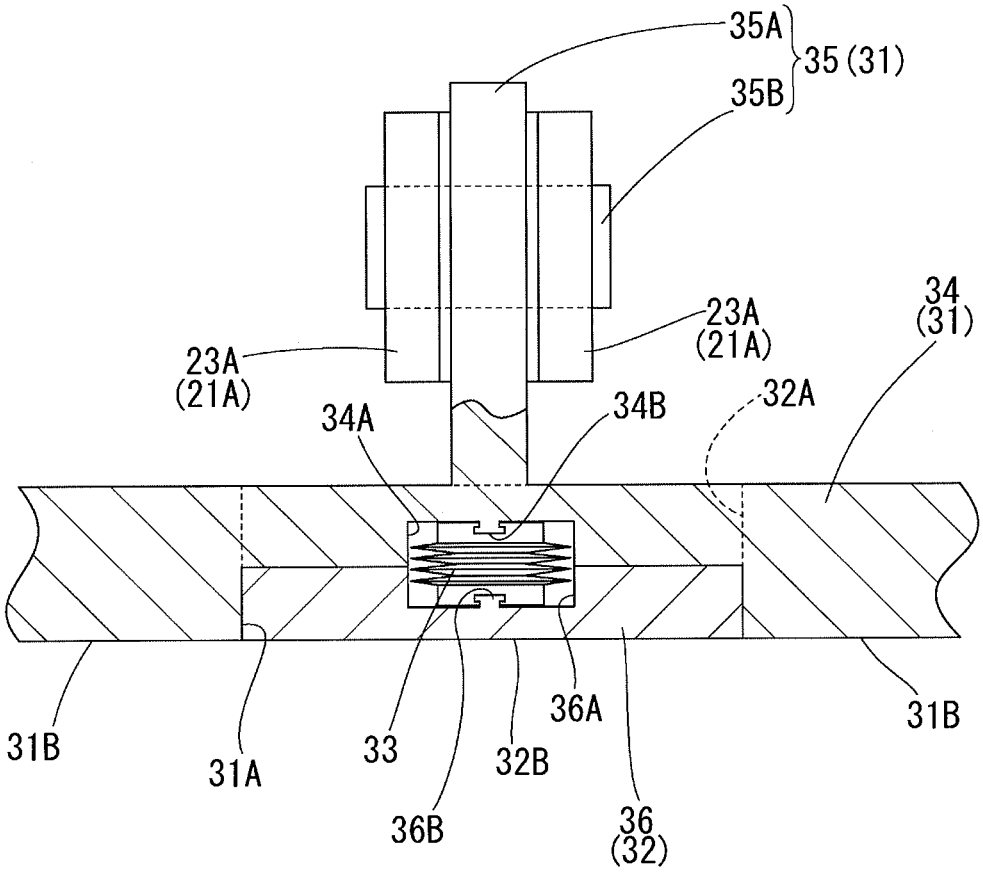
FIG. 3 is a sectional view taken along line X-X in FIG. 2.
Figure 4:
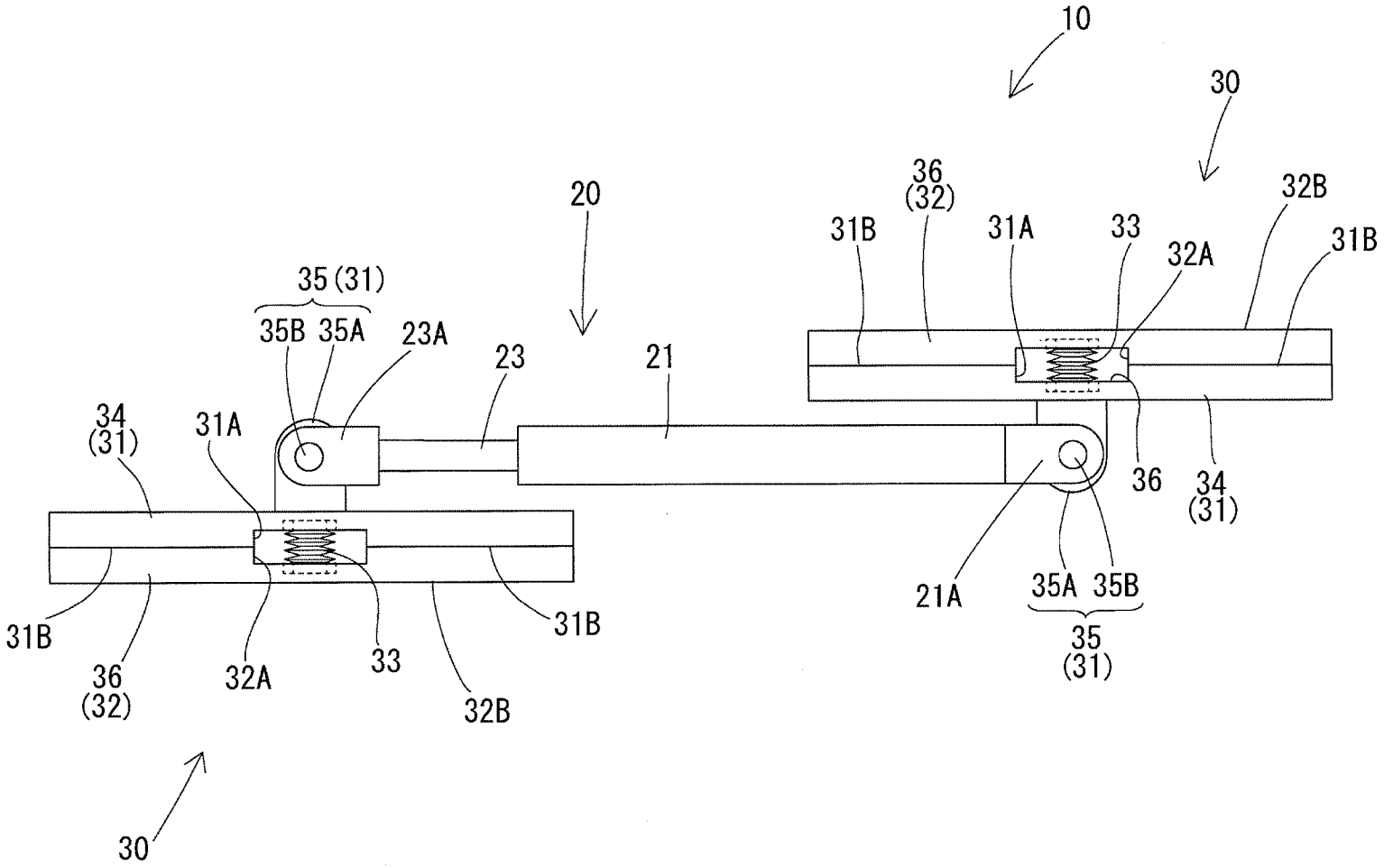
FIG. 4 is a side elevation of the overturn preventing device of the first embodiment, showing the setting part bodies in an unspread state.

The first flat plate 34 is formed with a groove 31A which is located in a longitudinal middle of the reverse side thereof and serves as a fitting portion, as shown in FIGS. 3 and 4. The groove 31A has two opposite sides perpendicular to two longitudinal sides of the first flat plate 34 and a bottom parallel to the obverse and reverse sides of the first flat plate 34. A distance between the opposite sides of the groove 31A is equal to a width of the first flat plate 34. Furthermore, the groove 31A has a depth that is one-half of a thickness of the first plate 34. The reverse side of the first flat plate 34 located at both sides of the groove 31A forms a first abutting surface 31B abutting against the top surface 1U of the furniture 1 or the ceiling C.

The connecting part 35 has a connecting part body 35A and a shaft member 35B as shown in FIGS. 2 to 5. The connecting part body 35A protrudes from the longitudinal middle of the obverse side of the first flat plate 34. The shaft member 35B is formed into a cylindrical shape and extends through a distal end of the connecting part body 35A in a direction perpendicular to a longitudinal direction of the first flat plate 34. The damper 20 has both ends (a distal end of the rod 23 and a proximal end of the cylinder 21) provided with a pair of damper side connecting parts 21A and 23A which interpose the connecting part body 35A respectively. The paired damper side connecting parts 21A or 23A are provided with through-holes respectively through which both ends of the shaft member 35B extend in a retained state. As a result, the damper 20 is connected so as to be rotatable about the shaft member 35B along the longitudinal direction of the first flat plate 34.

Figure 2:
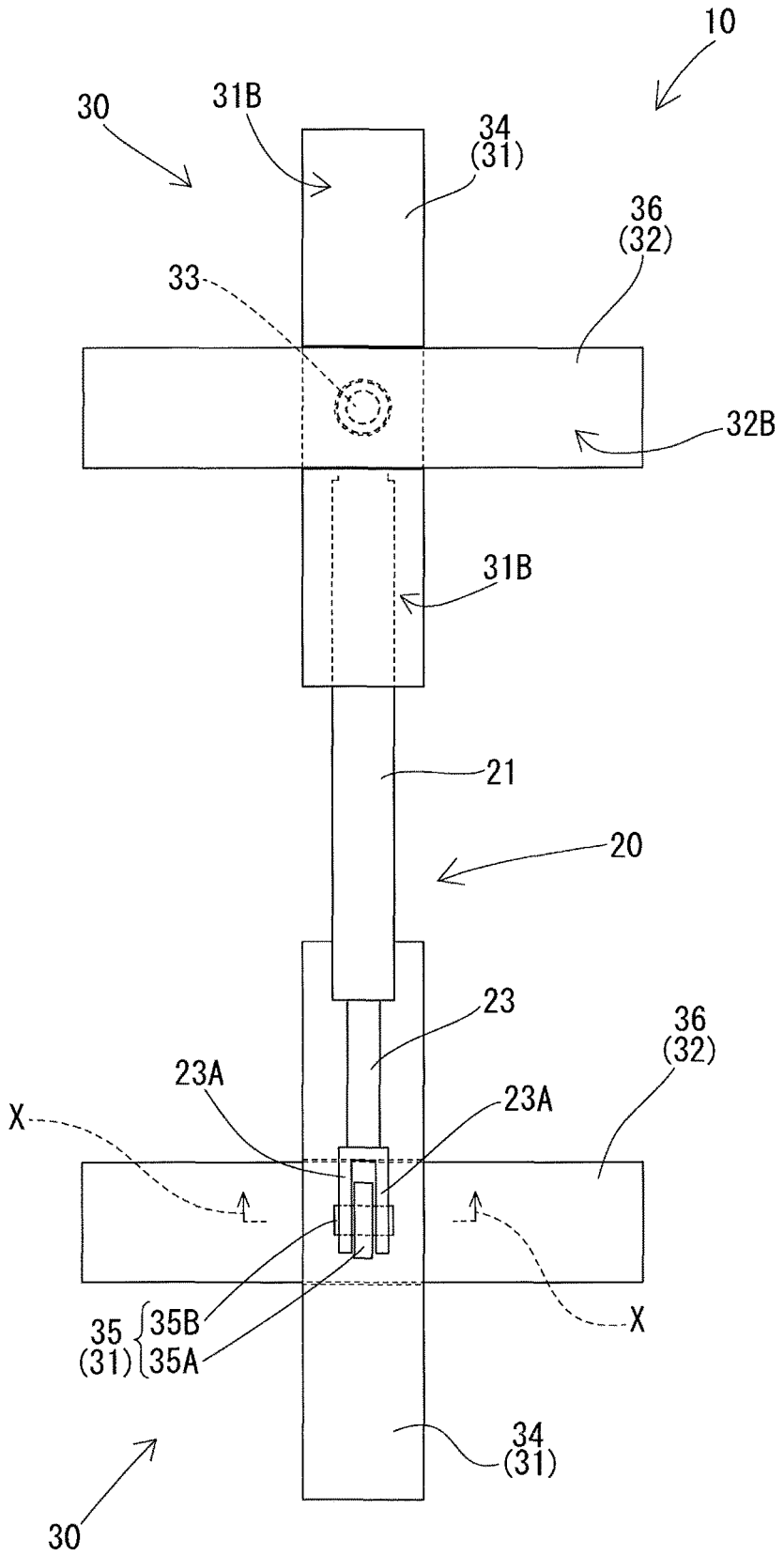
FIG. 2 is a plan view of the overturn preventing device of the first embodiment, showing the setting part bodies in a spread state.
Figure 5:
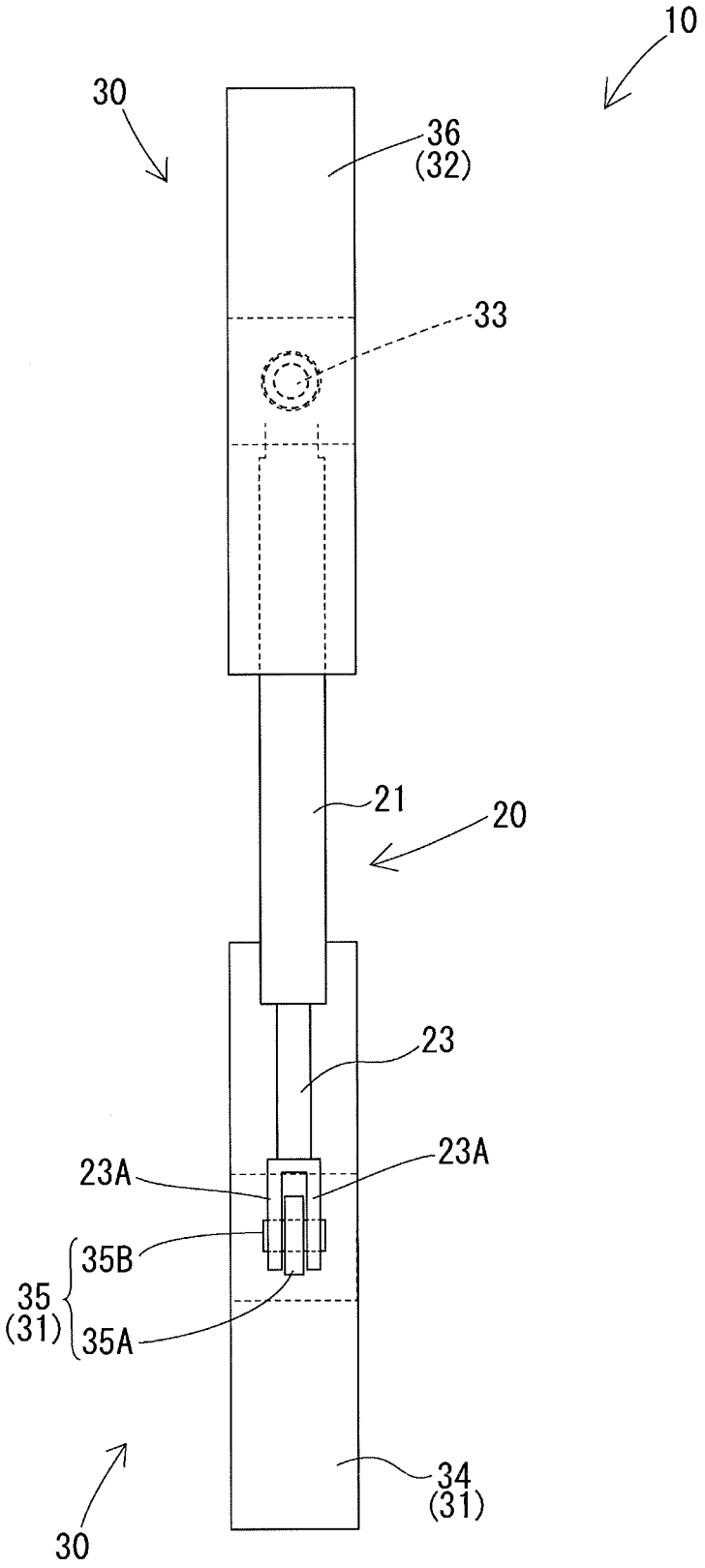
FIG. 5 is a plan view of the overturn preventing device of the first embodiment, showing the setting part bodies in the unspread state.

The second setting part body 32 includes a second flat plate 36 having an identical outer configuration with the first flat plate 34 of the first setting part body 31, as shown in FIGS. 2, 4 and 5. A groove 32A serving as a fitting portion is formed in a longitudinal middle of the obverse side of the second flat plate 36. The groove 32A also has two opposite sides perpendicular to two longitudinal sides of the second flat plate 36. A distance between the opposite sides of the groove 32A is equal to a width of the second flat plate 36. Furthermore, the groove 32A has a depth that is one-half of a thickness of the second flat plate 36. The reverse side of the second flat plate 36 forms a second abutting surface 32B abutting against the top surface 1U of the furniture 1 or the ceiling C.

The rotating shaft 33 has two ends connected to central parts of grooves 31A and 32A formed in the first and second flat plates 34 and 36 respectively, as shown in FIGS. 3 and 4. In more detail, the first and second flat plates 34 and 36 have recesses 34A and 36A formed in middle parts of the grooves 31A and 32A respectively, as shown in FIG. 3. The recesses 34A and 36A have protrusions 34B and 36B which are formed on the middle parts thereof and have distal ends outwardly spread to be formed into flanges, respectively. The protrusions 34B and 36B are fitted in recesses formed in both ends of the rotating shaft 33 in a retained state, respectively. Thus, the first and second setting part bodies 31 and 32 are rotatably connected by the rotating shaft 33. The rotating shaft 33 includes an axial middle formed into an accordion type, thereby being telescopic.

When each setting member 30 is mounted to the top surface 1U of the furnace 1 or the ceiling C, the first and second setting part bodies 31 and 32 are spread so as to be located to be perpendicular to each other, as shown in FIGS. 1 to 3. In this case, the rotating shaft 33 of each setting member 30 is contracted with the result that the grooves 31A and 32A of the first and second flat plates 34 and 36 serving as the fitting portions are fitted with each other, so that the first and second abutting surfaces 31B and 32B of the first and second flat plates 34 and 36 become coplanar. Thus, when the overturn preventing device 10 is mounted between the top surface 1U of the furniture 1 and the ceiling C, the first and second setting part bodies 31 and 32 are spread, whereby the first and second abutting surfaces 31B and 32B can be caused to abut against the top surface 1U of the furniture 1 or the ceiling C.

Furthermore, the first and second setting part bodies 31 and 32 can be caused to overlap without being spread, into such a shape as to extend in one direction, as shown in FIGS. 4 and 5. When the damper 20 is rotated so that the axis line thereof is parallel to the direction in which each setting member 30 extends, the overturn preventing device 10 can assume such a shape as to be long in one direction (the up-down direction in FIG. 5).

The overturn preventing device 10 of the first embodiment includes the damper 20 mounted between the top surface 1U of the furniture 1 and the ceiling C and the setting members 30 connected to the ends of the damper 20 respectively. Each setting member 30 has the first and second setting part bodies 31 and 32. When the overturn preventing device 10 is mounted between the top surface 1U of the furniture 1 and the ceiling C, the first and second setting part bodies 31 and 32 are spread so as to be perpendicular to each other. Furthermore, the setting members 30 extend in one direction when the first and second setting part bodies 31 and 32 are not spread.

When the furniture 1 is tilted forward by quakes of earthquake or the like, the tilt of the furniture 1 is suppressed by the damping force of the damper 20 with the result that the furniture 1 is prevented from being overturned by the overturn preventing device 10 mounted between the top surface 1U of the furniture 1 and the ceiling C. When the overturn preventing device 10 is mounted between the top surface 1U of the furniture 1 and the ceiling C, the first and second setting part bodies 31 and 32 are spread so as to be located to be perpendicular to each other, so that the first and second abutting surfaces 31B and 32B extend in respective directions perpendicular to each other thereby to be caused to abut against the top surface 1U of the furniture 1 and the ceiling C. This increases an abutment area of each setting member 30 against the top surface 1U of the furniture 1 and the ceiling C. As a result, the overturn preventing device 10 can disperse the damping force of the damper 20 applied to the top surface 1U of the furniture 1 and the ceiling C when the furniture 1 is tilted forward. In other words, the damping force of the damper 20 applied to the top surface 1U of the furniture 1 and the ceiling C can cover a wide range and an applied force per unit area can be rendered smaller. Accordingly, the overturn preventing device 10 can be mounted to any portions of the top surface 1U of the furniture 1 and the ceiling C but not only to higher strength portions of the top surface 1U of the furniture 1 and the ceiling C, with the result that the furniture 1 can be prevented from being overturned due to quakes of earthquake or the like.

Accordingly, the overturn preventing device 10 of the first embodiment can successfully prevent the furniture 1 from being overturned.

Furthermore, the first and second setting part bodies 31 and 32 remain unspread until the overturn preventing device 10 is mounted between the top surface 1U of the furniture 1 and the ceiling C, so that the first and second setting part bodies 31 and 32 extend in one direction. More specifically, the setting members 30 are caused to extend in one direction and furthermore to be located so that the extension directions of the setting members 30 are parallel to the axis line of the damper 20. As a result, handling of the overturn preventing device 10, such as carrying, can be rendered easier until the overturn preventing device 10 is mounted between the top surface 1U of the furniture 1 and the ceiling C.

Furthermore, the first and second setting part bodies 31 and 32 have the respective grooves 31A and 32A serving as the fitting portions which cause the first and second abutting surfaces 31B and 32B to be coplanar. Accordingly, since this increases an abutment area of the setting members 30 against the top surface 1U of the furniture 1 and the ceiling C, the overturn preventing device 10 can disperse the damping force which the damper 20 applies to the top surface 1U of the furniture 1 and the ceiling C when the furniture 1 is tilted by quakes of earthquake or the like. Consequently, the overturn preventing device 10 can be mounted on any part of the top surface 1U of the furniture 1 and any part of the ceiling C without limitation to higher strength portions in order to prevent the article from being overturned by the quakes of earthquake or the like.

Second Embodiment

Figure 6:
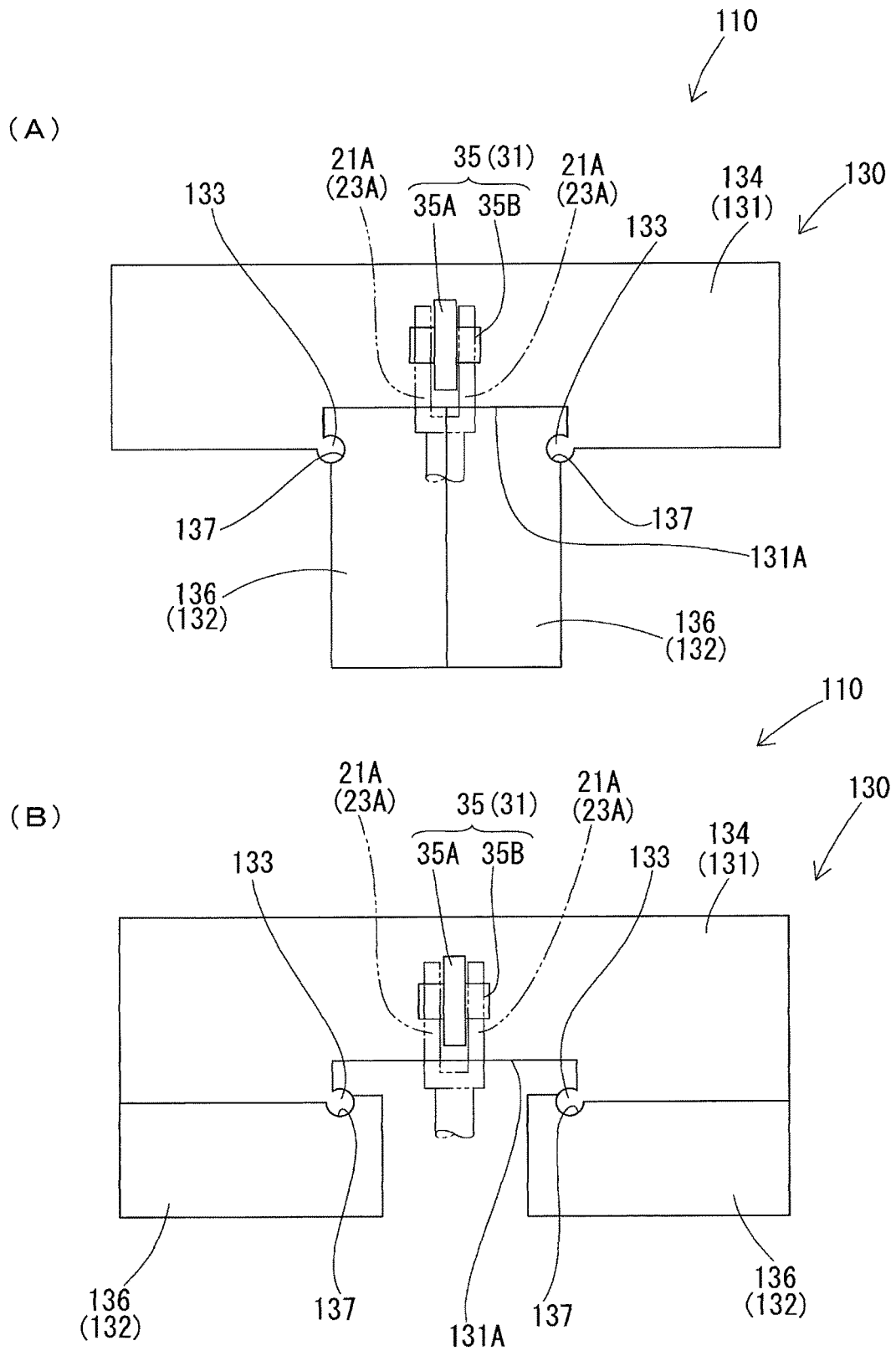
FIG. 6(A) is a plan view showing the setting part bodies in the spread state.
FIG. 6(B) is a plan view showing the setting part bodies in the unspread state in the overturn preventing device of a second embodiment, respectively.

An overturn preventing device 110 of a second embodiment differs from that of the first embodiment in the configuration of setting member 130 as shown in FIGS. 6(A) and 6(B). The second embodiment is identical with the first embodiment in the other construction. Accordingly, identical or similar parts in the second embodiment are labeled by the same reference symbols as those in the first embodiment and the description of these parts will be eliminated.

The setting member 130 of the overturn preventing device 110 includes a first setting part body 131 and two second setting part bodies 132. The first setting part body 131 includes a first flat plate 134 having a rectangle shape extending in one direction (a right-left direction in FIGS. 6(A) and 6(9)) and a connecting part 35 which is provided on a central part of an obverse side of the first flat plate 134 and to which one end of the damper 20 is connected. The first flat plate 134 has a groove 131A formed in a middle of one of the longitudinal sides thereof so as to extend continuously from the obverse side to the reverse side thereof. The groove 131A has two opposite sides perpendicular to a longitudinal side of the first flat plate 134 and a bottom parallel to the longitudinal side of the first flat plate 134. A distance between the opposite surfaces of the groove 131A is twice as long as a length of a lateral (shorter) side of a second flat plate 136 of the second setting part body 132. The first flat plate 134 has three-quarter cylindrical shafts 133 which are formed at corners between the opposite surfaces of the groove 131A and the longitudinal side of the first flat plate 134 and which extend from the obverse side to the reverse side of the first flat plate 134. The reverse side of the first flat plate 134 forms a first abutting surface which abuts against the top surface 1U of the furniture 1 or the ceiling C.

The connecting part 35 has a connecting part body 35A and a shaft member 35B. The connecting part body 35A protrudes from the longitudinal middle obverse side of the first flat plate 134. The shaft member 35B is cylindrical in shape and extends through a distal end of the connecting part body 35A in parallel to the longitudinal direction of the first flat plate 134. The damper 20 has both ends (a distal end of the rod 23 and a proximal end of the cylinder 21) provided with a pair of damper side connecting parts 21A and 23A which interpose the connecting part body 35A respectively. The paired damper side connecting parts 21A or 23A are provided with through-holes respectively through which both ends of the shaft member 35B extend in a retained state. Consequently, the damper 20 is connected to be rotatable in a direction perpendicular to the longitudinal direction of the first flat plate 134 about the shaft member 35B of the connecting part 35.

The second setting part bodies 132 have respective thicknesses equal to that of the first flat plate 134 and include respective second flat plates 136 having a rectangle shape and extending in one direction. Each second flat plate 136 has longitudinal sides one of which is formed with a semi-cylindrical recess 137 fitted with the shaft 133 of each first flat plate 134. The second flat plates 136 are rotatable about the shafts 133 relative to the first flat plates 134 respectively. As a result, the second setting part bodies 132 are rotatable between a spread state (see FIG. 6(A)) in which the longitudinal sides of the second setting part bodies 132 are perpendicular to longitudinal sides of the first setting part body 131 and the ends of the second setting part bodies 132 are fitted in the grooves 131A of the first flat plates 134, and an unspread state (see FIG. 6(B)) in which the longitudinal sides of the second setting part bodies 132 overlap the longitudinal sides of the first setting part body 131, respectively. The setting member 130 extends in one direction (in the right-left direction in FIGS. 6(A) and 6(B)) when the first and second setting part bodies 131 and 132 are unspread (an unspread state). The second flat plate 136 has a reverse side formed into a second abutting surface which abuts against the top surface 1U of the furniture 1 or the ceiling C.

When the setting members 130 are mounted between the top surface 1U of the furniture 1 and the ceiling C, the first and second setting part bodies 131 and 132 are spread with the result that the first and second abutting surfaces can be caused to abut against the top surface 1U of the furniture 1 or the ceiling C as shown in FIG. 6(A). On this occasion, since the setting member 130 assumes a T-shape in which the second setting part body 132 extends from only one of longitudinal sides of the first setting part body 131, the setting member 130 can be mounted while the other longitudinal side of the first setting part body 131 comes close to the rear surface 1B side (the wall surface W side) of the top surface 1U of the furniture 1. In this case, the damping force of the damper 20 can effectively be caused to act since the distal end of the rod 23 of the damper 20 connected to the setting member 130 is disposed near the rear surface 1B side of the top surface 1U of the furniture 1, which side is most displaceable when the furniture 1 is tilted forward by quakes of earthquake or the like.

The overturn preventing device 110 of the second embodiment is also provided with the damper 20 mounted between the top surface 1U of the furniture 1 and the ceiling C and the setting members 130 connected to both ends of the damper 20 respectively. Each setting member 130 has the first and second setting part bodies 131 and 132. The first and second setting part bodies 131 and 132 of each setting member 130 are spread into the T-shape when the overturn preventing device 110 is mounted between the top surface 1U of the furniture 1 and the ceiling C. Furthermore, each setting member 130 extends in one direction when the first and second setting part bodies 131 and 132 are unspread.

When the furniture 1 is tilted forward by quakes of earthquake or the like, the tilt of the furniture 1 is suppressed by the damping force of the damper 20 with the result that the furniture 1 is prevented from being overturned by the overturn preventing device 110 mounted between the top surface 1U of the furniture 1 and the ceiling C. When the overturn preventing device 110 is mounted between the top surface 1U of the furniture 1 and the ceiling C, the first and second setting part bodies 131 and 132 are spread into the T-shape, so that the first and second abutting surfaces extend into the T-shape and are caused to abut against the top surface 1U of the furniture 1 and the ceiling C respectively. As a result, the overturn preventing device 110 can disperse the damping force of the damper 20 applied to the top surface 1U of the furniture 1 and the ceiling C when the furniture 1 is tilted forward. More specifically, the damping force of damper 20 applied to the top surface 1U of the furniture 1 and the ceiling C can cover a wide range and an applied force per unit area can be rendered smaller. Accordingly, the overturn preventing device 110 can be mounted to any portions of the top surface 1U of the furniture 1 and the ceiling C but not only to higher strength portions of the top surface 1U of the furniture 1 and the ceiling C, with the result that the furniture 1 can be prevented from being overturned due to quakes of earthquake or the like.

Accordingly, the overturn preventing device 110 of the second embodiment can successfully prevent the furniture 1 from being overturned.

Furthermore, the first and second setting part bodies 131 and 132 remain unspread until the overturn preventing device 110 is mounted between the top surface 1U of the furniture 1 and the ceiling C, so that the first and second setting part bodies 131 and 132 extend in one direction. As a result, handling of the overturn preventing device 110, such as carrying, can be rendered easier until the overturn preventing device 110 is mounted between the top surface 1U of the furniture 1 and the ceiling C.

Third Embodiment

Figure 7:
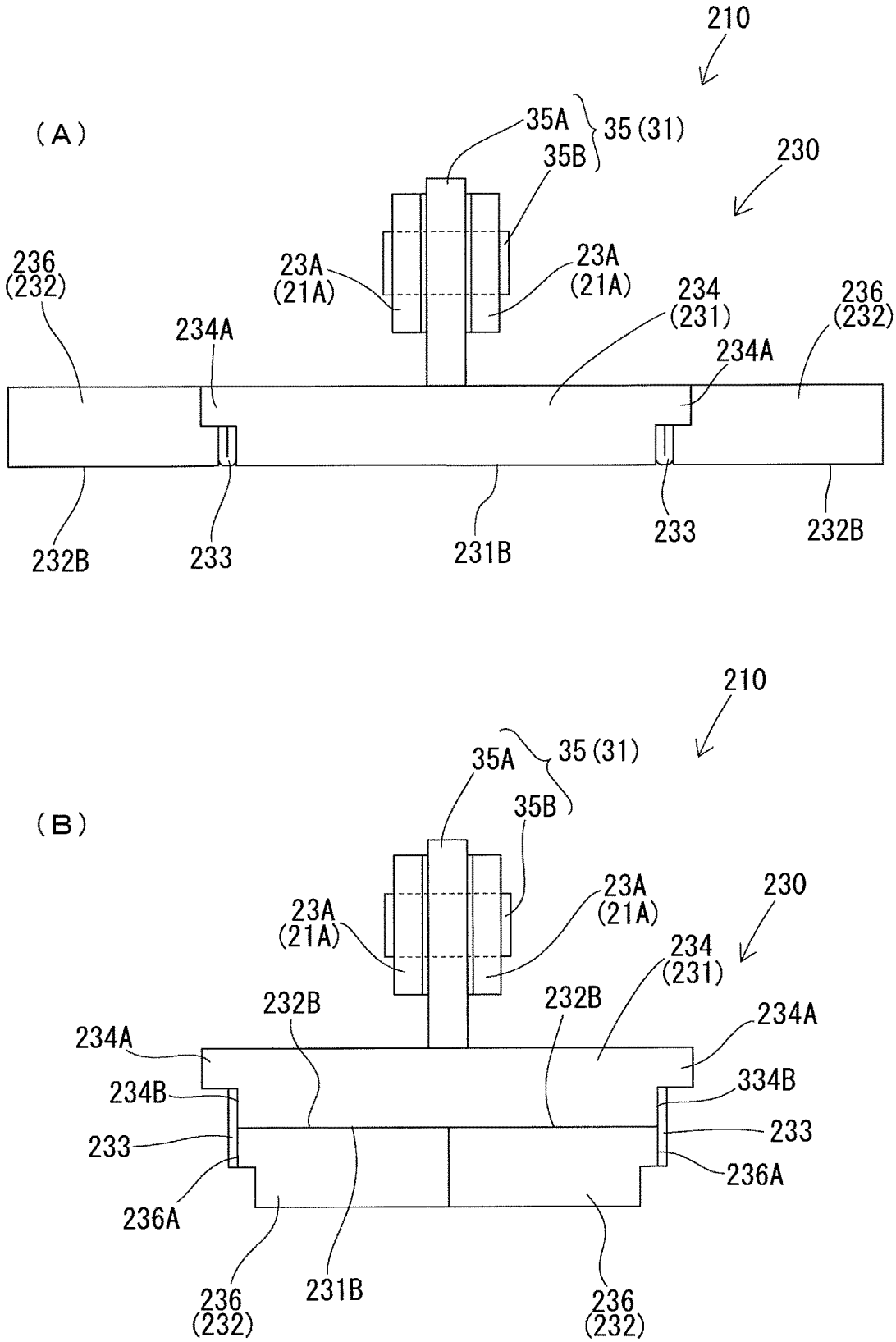
FIG. 7(A) is a side elevation showing the setting part bodies in the spread state.
FIG. 7(B) is a side elevation showing the setting part bodies in the unspread state in the overturn preventing device of a third embodiment, respectively.

An overturn preventing device 210 of a third embodiment differs from those of the first and second embodiments in the configuration of setting member 230 as shown in FIGS. 7(A) and 7(B). The third embodiment is identical with the first and second embodiments in the other construction. Accordingly, identical or similar parts in the third embodiment are labeled by the same reference symbols as those in the first and second embodiments and the description of these parts will be eliminated.

The setting member 230 of the overturn preventing device 210 includes a first setting part body 231, two second setting part bodies 232 and rotating members 233 rotatably connecting the first setting part body 231 and the respective second setting part bodies 232 between the spread state and the unspread state. The first setting part body 231 includes a first flat plate 234 having a rectangle shape and extending in one direction (a depthwise direction in FIGS. 7(A) and 7(B)) and a connecting part 35 which is provided on a central part of an obverse side of the first flat plate 234 and to which one end of the damper 20 is connected. The first flat plate 234 has a concavo-convex shape such that obverse-side portions of both longitudinal sides thereof protrude farther than reverse-side portions. Each convex portion 234A at the obverse side is formed into a square prism extending in a longitudinal direction of the first flat plate 234 and has a thickness that is one half of that of the first flat plate 234. The first flat plate 234 has a reverse side formed into a first abutting surface 231B which abuts against the top surface 1U of the furniture 1 or the ceiling C.

The connecting part 35 has a connecting part body 35A and a shaft member 35B. The connecting part body 35A protrudes from the lateral middle obverse side (the right-left direction in FIGS. 7(A) and 7(B)) of the first flat plate 234. The shaft member 35B is cylindrical in shape and extends through a distal end of the connecting part body 35A in parallel to the lateral direction of the first flat plate 234. The damper 20 has both ends (a distal end of the rod 23 and a proximal end of the cylinder 21) provided with a pair of damper side connecting parts 21A and 23A which interpose the connecting part body 35A respectively. The paired damper side connecting parts 21A or 23A are provided with through-holes respectively through which both ends of the shaft member 35B extend in a retained state. Consequently, the damper 20 is connected to be rotatable about the shaft member 35B of the connecting part 35 along the longitudinal direction of the first flat plate 134.

The second setting part bodies 232 have respective thicknesses equal to that of the first flat plate 234 and include respective second flat plates 236 having a rectangle shape and extending in one direction (the depthwise direction in FIGS. 7(A) and 7(B)). As shown in FIG. 7(A), each second flat plate 236 has two longitudinal (the depthwise direction in FIGS. 7(A) and 7(B)) sides one of which is formed into a concavo-convex portion to be fitted with the concavo-convex portion of the longitudinal side surface of the first flat plate 234, so that the second flat plates 236 are fitted with both longitudinal side surfaces of the first flat plate 234 when the setting member 230 is spread. Each second flat plate 236 has a reverse side formed into a second abutting surface 232B which abuts against the top surface 1U of the furniture 1 or the ceiling C.

Each rotating member 233 is formed into a tape-shape and attached to an end surface of the longitudinal side concave portion 234B of the first flat plate 234 and the longitudinal side convex portion 236A of the longitudinal side of the second flat plate 236. Each rotating member 233 is foldable at a boundary between the first and second flat plates 234 and 236.

When the setting members 230 are mounted between the top surface 1U of the furniture 1 and the ceiling C, the first and second setting part bodies 231 and 232 are spread with the result that the first and second abutting surfaces 231B and 232B can be caused to abut against the top surface 1U of the furniture 1 or the ceiling C, as shown in FIG. 7(A). Furthermore, when unspread, the first and second setting part bodies 231 and 232 can be caused to overlap without being spread, into such a shape as to extend in one direction. When the damper 20 is rotated so that the axis line thereof is parallel to the direction in which each setting member 230 extends, the overturn preventing device 210 can assume such a shape as to be long in one direction.

The overturn preventing device 210 of the third embodiment also includes the damper 20 mounted between the top surface 1U of the furniture 1 and the ceiling C, and the setting members 230 connected to both ends of the damper 20 respectively. Each setting member 230 has the first setting part body 231 and the second setting part bodies 232. When the overturn preventing device 230 is mounted between the top surface 1U of the furniture 1 and the ceiling C, the first and second setting part bodies 231 and 232 of each setting member 230 are spread. Furthermore, each setting member 230 assumes such a shape as to extend in one direction when remaining unspread.

When the furniture 1 is tilted forward by quakes of earthquake or the like, the tilt of the furniture 1 is suppressed by the damping force of the damper 20 with the result that the furniture 1 is prevented from being overturned by the overturn preventing device 210 mounted between the top surface 1U of the furniture 1 and the ceiling C. When the overturn preventing device 210 is mounted between the top surface 1U of the furniture 1 and the ceiling C, the first and second setting part bodies 231 and 232 are spread and the first and second abutting surfaces 231B and 232B are caused to abut against the top surface 1U of the furniture 1 and the ceiling C. As a result, the overturn preventing device 210 can disperse the damping force of the damper 20 applied to the top surface 1U of the furniture 1 and the ceiling C when the furniture 1 is tilted forward. In other words, the damping force of damper 20 applied to the top surface 1U of the furniture 1 and the ceiling C can cover a wide range and an applied force per unit area can be rendered smaller. Accordingly, the overturn preventing device 210 can be mounted to any portions of the top surface 1U of the furniture 1 and the ceiling C but not only to higher strength portions of the top surface 1U of the furniture 1 and the ceiling C, with the result that the furniture 1 can be prevented from being overturned due to quakes of earthquake or the like.

Accordingly, the overturn preventing device 210 of the third embodiment can successfully prevent the furniture 1 from being overturned.

Furthermore, the first and second setting part bodies 231 and 232 remain unspread until the overturn preventing device 210 is mounted between the top surface 1U of the furniture 1 and the ceiling C, so that the first and second setting part bodies 231 and 232 extend in one direction. In other words, each setting member 230 assumes such a shape as to extend in one direction and furthermore, each setting member 230 is located so that the extension direction thereof and the axis line of the damper 20 are parallel to each other. As a result, handling of the overturn preventing device 210, such as carrying, can be rendered easier until the overturn preventing device 210 is mounted between the top surface 1U of the furniture 1 and the ceiling C.

The present invention should not be limited to the first to third embodiments described above with reference to the drawings, but the technical scope of the invention encompasses the following embodiments, for example.

(1) Although the overturn preventing device is mounted between the top surface of the furniture and the ceiling in each of the first to third embodiments, the overturn preventing device may be mounted between a rear surface of the furniture and a wall surface or between an underside of the furniture and a floor surface.

(2) Although the damper is the compression damper in each of the first to third embodiments, the damper may be a bidirectional damper or an extension damper. When the bidirectional damper or the extension damper is used, the setting members are fixed to the top surface of the furniture and the ceiling respectively.

(3) Although the setting members are connected to both ends of the damper respectively in each of the first to third embodiments, one setting member may be connected to one of the ends of the damper. In this case, a mounting member whose shape is not changed is connected to the other end of the damper. The mounting member is mounted to the top surface of the furniture or the ceiling.

(4) Although the connecting part rotates the damper in one direction in each of the first to third embodiments, the setting member may be connected to the damper by a free joint rotatable in any direction.

(5) Although each setting member has two members, that is, the first and second setting part bodies in the first embodiment, each setting member may have three or more members to be spread.

EXPLANATION OF REFERENCE SYMBOLS

1 . . . furniture (article), C . . . ceiling, W . . . wall surface, 10, 110 and 210 . . . overturn preventing device, 20 . . . damper, 30, 130 and 230 . . . setting member, 31, 131 and 231 . . . first setting part body (setting part body), 32, 132 and

232 . . . second setting part body (setting part body), 35 . . . connecting part, and 31A and 32A . . . groove (fitting portion).

The invention claimed is:

1. An overturn preventing device comprising:

a damper mounted between an article installed on an installation surface and a ceiling, between the article installed on the installation surface and a wall surface extending in a vertical direction from the installation surface, or between the article installed on the installation surface and the installation surface; and a setting member connected to at least a first one of two ends of the damper and having a plurality of setting part bodies, said setting member being changeable between a spread state in which the setting part bodies extend in respective directions perpendicular to each other and an unspread state in which the setting part bodies extend in one direction, the setting part bodies in the spread state abutting against the article, the ceiling, the wall surface, or the installation surface when the damper is to be mounted between the article and the ceiling, between the article and the wall surface, or between the article and the installation surface.

2. The overturn preventing device according to claim 1, wherein the setting member has a connecting part rotatably connected to the first end of the damper so that the setting part bodies, when in the unspread state, are configured as to extend parallel with an axis line of the damper.

3. The overturn preventing device according to claim 1, wherein the setting part bodies have abutment surfaces configured for abutment against the article, the ceiling, the wall surface, or the installation surface when the damper is mounted between the article and the ceiling, between the article and the wall surface, or between the article and the installation surface, and wherein the setting part bodies have respective fitting portions which are fitted with each other when in the spread state, so that abutment surfaces of the setting part bodies are coplanar.

4. An overturn preventing device, comprising:

a damper mounted between an article installed on an installation surface and a respective one of (i), (ii) and (iii);

(i) a ceiling, (ii) a wall surface extending in a vertical direction from the installation surface, and (iii) the installation surface; and a setting member connected to at least a first one of two ends of the damper and having a plurality of setting part bodies, said setting member being configured to be changed between a spread state in which the setting part bodies extend in respective directions perpendicular to each other and an unspread state in which the setting part bodies extend in a common direction of elongation, the setting part bodies being configured to abut against a respective one of (i), (ii), (iii) or the article in the spread state.

5. The overturn preventing device according to claim 4, wherein the common direction of elongation includes a parallel arrangement featuring each of the setting part bodies positioned to one side of the damper and extending parallel with a central axis of elongation of the damper.

6. The overturn preventing device according to claim 4, wherein the common direction of elongation includes a parallel arrangement featuring the damper positioned between the setting part bodies such that the setting part bodies are positioned to opposite sides of the damper and extend parallel with a central axis of elongation of the damper.

7. An overturn preventing device, comprising:

a damper mounted between an article installed on an installation surface and a respective one of (i), (ii) and (iii);

(i) a ceiling, (ii) a wall surface extending in a vertical direction from the installation surface, and (iii) the installation surface; and a setting member connected to at least a first one of two ends of the damper and having a plurality of setting part bodies, said setting member being configured to be changed between a spread state and an unspread state, with each of said setting part bodies being configured to abut against a respective one of (i), (ii), (iii) or the article in the spread state; and said setting member being configured such that there is an increased amount of flush, planar mutual surface contact in the setting part bodies when in the unspread state as compared to the spread state.

8. The overturn preventing device according to claim 7, wherein the setting member includes at least one pivot location between the setting part bodies with the pivot location being arranged such that a rotation of the setting part bodies about the at least one pivot location alters the amount of flush, planar mutual surface contact in the setting part bodies.

9. The overturn preventing device according to claim 8, wherein the setting part bodies rotate into a transverse relationship when in the spread state.

* * * * *